US005318730A

United States Patent [19]

Rieser et al.

[11] Patent Number: 5,318,730

[45] Date of Patent: Jun. 7, 1994

[54] PROCESS FOR CONTAINMENT OF HAZARDOUS WASTES

[75] Inventors: Linda A. Rieser, Cleves; John M. Christenson, Cincinnati, both of Ohio

[73] Assignee: University of Cincinnati, Cincinnati, Ohio

[21] Appl. No.: 672,001

[22] Filed: Mar. 18, 1991

Related U.S. Application Data

[63] Continuation of Ser. No. 329,804, Mar. 28, 1989, abandoned.

[51] Int. Cl.[5] ..... G21F 9/16; G21F 9/34; G21F 9/36

[52] U.S. Cl. ..... 252/628; 252/633; 427/5; 427/6; 427/220; 427/221; 427/385.5; 523/375; 976/DIG. 385; 976/DIG. 394; 976/DIG. 395

[58] Field of Search ..... 252/628, 631, 633; 427/5, 6, 220, 221, 385.5; 976/DIG. 385, DIG. 394, DIG. 395; 523/375; 525/162, 163, 515

[56] References Cited

U.S. PATENT DOCUMENTS

| | | | |
|---|---|---|---|
| 3,996,177 | 12/1976 | Ludwig | 525/162 |
| 4,007,147 | 2/1977 | Leeson et al. | 524/394 |
| 4,077,901 | 3/1978 | Arnold et al. | 252/628 |
| 4,257,912 | 3/1981 | Fleischer et al. | 252/628 |
| 4,267,089 | 5/1981 | Brown | 428/522 |
| 4,382,026 | 5/1983 | Drake et al. | 252/628 |
| 4,405,512 | 9/1983 | Filter et al. | 252/628 |
| 4,459,211 | 7/1984 | Carini | 210/751 |
| 4,459,212 | 7/1984 | Carini | 210/751 |
| 4,671,040 | 6/1987 | Braithwaite, Jr. | 427/260 |
| 4,764,305 | 8/1988 | deTassigny | 252/628 |
| 4,770,715 | 9/1988 | Mandel et al. | 134/40 |

*Primary Examiner*—Howard J. Locker
*Attorney, Agent, or Firm*—Frost & Jacobs

[57] ABSTRACT

A method and composition for stabilizing and isolating hazardous, radioactive or mixed waste materials of particulate and solid types, which comprises providing a non-toxic one component aqueous mixture of an acrylic polymer containing a thixotropic agent, a vinyl acetate-ethylene copolymer containing a thixotropic agent, or a vinyl chloride copolymer latex containing a thixotropic agent, and applying the mixture over surfaces of hazardous material in an amount sufficient to form a flexible impermeable coating or foam. The mixture may be applied by spraying to form a coating having a thickness of about 0.5 to about 5.0 centimeters when dry. The coated waste material may then be disposed of in conventional manner.

21 Claims, No Drawings

PROCESS FOR CONTAINMENT OF HAZARDOUS WASTES

This is a continuation, of application Ser. No. 07/329,804, filed Nov. 28, 1989 (abandoned).

BACKGROUND OF THE INVENTION

1. Field of the Invention

The present invention relates to a method for containing hazardous, radioactive or mixed waste materials, and in particular, to compositions of acrylic emulsions containing a thixotropic agent, vinyl acetate-ethylene copolymer emulsions containing a thixotropic agent, or vinyl chloride copolymer latices containing a thixotropic agent which can be sprayed over, or otherwise applied to, contaminated areas to generate a flexible film or foam which entraps and immobilizes the hazardous, radioactive or mixed materials therein.

2. Description of the Prior Art

Most of the prior art for containment of hazardous waste materials utilizes compositions of natural and synthetic rubbers, silicates, or alkanolamines to provide solid masses containing the waste material. For example, U.S. Pat. No. 2,577,514, issued Dec. 4, 1951, to J. De Ment, discloses a method whereby certain reactive compounds of silicon are employed to react with the soluble radioactive compounds to form substantially insoluble derivatives thereof. The composition includes a soluble sodium silicate, dilute hydrochloric acid which forms silicic acid, and then water is utilized to wash away the reaction products and radioactive contaminants carried therein.

U.S. Pat. No. 3,063,873, issued Nov. 13, 1962, to J. R. Saroyan, discloses a protective coating composition which is applied to a surface prior to contamination to form a dried film covering the surface. After contamination, the coating can be washed off by steam or hot water which carries with it the radioactive particles embedded therein. The coating composition is a high polymer plastic of either the elastomeric (natural and synthetic rubbers) or the thermoplastic type (bitumins, vinyls, polystyrene, polyethylene, acrylics, silicones, celluloses, and polyamides) formulated with a water sensitive adhesion modifier of a hydrophilic film forming material. The process comprises applying a substantial layer of an alkali-sensitive coating composition formed of a polymer resin, ammonium hydroxide, water, and pine oil, and then washing the coating off with an alkali solution after contamination.

Prior art references which disclose the use of urea-formaldehyde solutions for containment of hazardous waste materials are all directed to forming a solid mass which contains the hazardous materials and can be disposed of by burying. However, present EPA regulations prohibit the use of urea-formaldehyde resins for this purpose due to the carcinogenic nature thereof.

SUMMARY OF THE INVENTION

It is an object of the present invention to provide a composition and a method which can stabilize and control hazardous, radioactive or mixed waste materials.

It is further object of the invention to provide a method for isolating hazardous waste material by forming a non-strippable barrier thereon of sufficient permanence to permit disposal at a later date.

It is another object of the invention to provide a method for containment of hazardous waste materials in particulate or solid form with a premixed, i.e. one component, water based mixture, preferably an emulsion, of low toxicity and relatively low cost which forms a rapid setting, flexible coating which bonds to a large variety of waste materials.

The above and other objects of the invention are obtained in a method for stabilizing and isolating hazardous waste materials of particulate and solid types, which comprises providing a non-toxic aqueous mixture, preferably an emulsion of an acrylic polymer, a vinyl acetate-ethylene copolymer, or a vinyl chloride copolymer latex, adding a thixotropic agent to the mixture in an amount sufficient to obtain a viscosity which will minimize run-off of the mixture when applied to surfaces of hazardous waste material, and applying the mixture containing the thixotropic agent over the surfaces of hazardous waste material in an amount sufficient to form a flexible impermeable coating or foam having a thickness ranging from about 0.5 to about 5.0 centimeters when dry.

Preferably the method of the invention involves application of the mixture by spraying with conventional spray equipment.

A preferred emulsion for the practice of the invention is an acrylic polymer emulsion having about 55% to about 65% by weight solids, to which a polyacrylic acid having a molecular weight of about 150,000 to about 275,000 is added as a thixotropic agent in amounts up to about 3% by weight. Such a composition can be used for the containment of radioactive waste materials.

DETAILED DESCRIPTION OF THE INVENTION

The present invention provides numerous advantages over prior art methods and compositions for containment of hazardous waste materials. The compositions which are used are water-based and hence there are no organic solvents to complicate disposal. The compositions have low toxicity, are relatively low in cost, simple to apply since the compositions are one component systems (i.e. are premixed), and have long shelf life. The coatings produced by application in accordance with the method of the invention are flexible, rapid setting, bond easily to a large variety of materials, exhibit minimal shrinkage during or after drying and are relatively unaffected by low level radioactive materials.

The method of the invention has utility for numerous applications such as soil cover, temporary debris stabilization, emergency response, fly ash containment, radioactive dust control, control of radon gas, concrete and/or asphalt coating to prevent radioactive waste contamination, run-off control of mill tailings, or other radioactive particulates, and mothballing plant equipment or machinery which has become contaminated by radioactive materials.

A preferred acrylic latex composition for use in the method of the invention contains, in weight percent, from about 60% to about 65% acrylic polymer, up to about 2% polyacrylic acid having a molecular weight of about 250,000, up to about 1.5% nonionic surfactant, up to about 5% pigment, and balance water. Suitable acrylic polymers include those sold under the trademarks "UCAR 100" or "UCAR 163" by Union Carbide Corporation.

A vinyl acetate-ethylene composition contains, in weight percent, from about 40% to about 60% of a vinyl acetate-ethylene copolymer, up to about 3% of a thixotropic agent comprising an alkoxypolyethylene glycol or an alkoxypropylene glycol having a molecular weight of at least about 1500, up to about 1.5% surfactant, up to about 5% pigment, and balance water. Suitable vinyl acetate-ethylene copolymers include those sold under the trademark "AIR FLEX 420" or "AIR FLEX 500" by Air Products Company. Proprietary products sold under the trademark "CARBOPOL" by B. F. Goodrich Chemical Company have been found to be satisfactory as a thixotropic agent.

A vinyl chloride copolymer latex composition suitable for use in the method of the invention where non-radioactive materials are to be contained comprises, in weight percent, from about 40% to about 60% solids, up to about 5% sodium or ammonium polyacrylate as a thixotropic agent, up to about 1.5% surfactant, and balance water. A suitable vinyl chloride copolymer latex is sold under the trademark "GEON 460×46" by B. F. Goodrich Chemical Company.

It is within the scope of the invention to add conventional foaming agents. When a foam coating is applied, the thickness of the coating should be in the upper portion of the range, i.e. about 2 to about 5.0 centimeters when dry.

Other optional ingredients which may be added include:

(1) plasticizers, such as that sold under the trademark "SANTICIZER 160" by Monsanto Company, to improve low temperature flexibility of the coatings; amounts ranging from about 5% to about 20% by weight are useful; a plasticizer of this type could also be used as a thickening agent by raising the solids content;

(2) other types of surfactants such as that sold under the trademark "COMPOSITION T" by Merck & Co., Inc., in amounts ranging from about 0.01% to about 2% by weight;

(3) adhesion enhancers, such as organofunctional silanes, to promote adhesion between the polymeric barrier coating and inorganic substrates; a product sold under the trademark "A-100" by Union Carbide Corporation is useful, in amounts ranging from about 0.1% to about 5.0% by weight;

(4) mildewicides, such as that sold under the trademark "SKANE M8" by Rohm & Haas Company, for long term applications; amounts ranging from about 0.1% to about 1.0% by weight are useful.

Pilot scale field tests at a uranium feed materials production center have been conducted. Test sections, each having a surface area between 50 and 100 square feet, were treated. One test section was excavated soil, another test section was fly ash, while a third test section was an unpaved roadway surface. In most of these tests, a primary coating of premixed emulsion was first applied by spraying, followed after it set in about thirty minutes by application of a secondary coating over the primary coating substrate surface. This is the preferred procedure for loose substrate material. However, it is within the scope of the invention to utilize only a single coating step wherein omission of a primary coat would be compensated by application of a greater amount of a single secondary coating.

The composition of the primary coating used in the field tests was as follows:

| | % by weight |
|---|---|
| Modified acrylic latex emulsion (62% solids by weight) UCAR 100 from Union Carbide Corp. | 89.3 |
| Surfactant (non-ionic) Triton X-100 from Rohm & Haas Co. | 1.0 |
| Water | 9.7 |

-continued

The composition of the secondary coating used in the field tests was as follows:

| | % by weight |
|---|---|
| Modified acrylic latex emulsion (62% solids by weight) UCAR 100 from Union Carbide Corp. | 96.0 |
| Suspended pigment | 3.0 |
| Acrylic acid thixotropic agent (250,000 m.w. -10% aqueous solution) | 1.0 |

In the secondary coating material, the pigment was used in order to provide a distinctive dark color which facilitated confirmation of film continuity by visual inspection and later delineation of the test area. The use of a pigment is considered to be optional.

A test section was prepared having a surface area of about 57 square feet using recently excavated soil from the uranium feed materials processing site. Dimensions of the test area were about 8.2 feet in length, about 5.7 feet in width, and about 1.4 feet in height. A volume of 0.93 gallon of primary composition was applied, and 10.0 gallons of the secondary composition were then applied after 30 minutes. The spray equipment utilized for application included a DeVilbiss air operated high pressure supply pump (Model QEX-R80-A4 with a fluid to air pressure ratio of 33:1); a DeVilbiss spray gun (Model VGB-511); fluid nozzles (maximum orifice size 0.054 inch); mastic fluid tips (maximum orifice size 0.072 inch); and associated equipment including an air regulator kit, high pressure surge chamber and diesel operated high delivery air compressor.

The second test section comprised a conically shaped pile of weathered fly ash and a relatively flat adjoining triangular area at the base of the pile. The pile of fly ash had a diameter of about 7 feet and a height of about 2.75 feet. The triangular area had a base of 6 feet and sides of about 7.7 feet. In this test, 2.9 gallons of the primary composition were applied, followed by application of 8.8 gallons of the secondary composition using the same equipment and method of application described above.

The third test section was a compacted unpaved roadway surface covered with chipped limestone and larger gravel. This area was subdivided into four parts, and several combinations of primary and secondary coatings were applied. The areas, volumes, and compositions applied to each part were as follows:

| Section | Area (sq. ft.) | Composition | Volume (gals.) |
|---|---|---|---|
| A | 90 | Primary | 2.2 |
| | | Secondary | 4.0 |
| B | 84 | Primary | 2.2 |
| C | 79.9 | Primary | 2.2 |
| | | Secondary | 3.3 |
| D | 100.6 | Secondary | 8.4 |

Subsequent to application, traffic conditions over these test sections varied. Sections A and B supported heavy truck traffic, while sections C and D supported car and light truck traffic.

Thirty days after application of the coatings to the test areas, visual monitoring indicated no visual evidence of weathering despite exposure to wind, rain, sunlight, and associated thermal cycling in the excavated soil and fly ash test sections. The roadway test sections also indicated no degradation by natural weathering. However, heavy vehicular traffic caused some mechanical damage to the material. Section A showed some minor stress cracking due to the movement of large diameter stones displaced by tire rotation. Section B, to which only a primary composition was applied, showed an almost total loss of integrity. Section C and section D showed minor abrasive stress cracking.

A cost analysis of the compositions applied in the above tests indicated a range of 15¢ per square foot (primary coating only) to $1.40 per square foot (excavated soil). Adjustments to coating thickness and use of extenders or fillers could further reduce these costs.

Subsequent inspection of the test areas after six months exposure to weathering indicated total containment of the excavated soil and fly ash test sections.

Modifications may be made without departing from the spirit and scope of the invention, and no limitations are to be inferred except as set forth in the appended claims.

What we claim is:

1. A method for stabilizing and isolating hazardous waste materials of particulate and solid types, which comprises providing a non-toxic aqueous composition containing a polymer or copolymer chosen from the group consisting of an acrylic polymer, a vinyl acetate-ethylene copolymer, and a vinyl chloride copolymer latex, adding a thixotropic agent to said composition in an amount sufficient to obtain a viscosity which will minimize run-off of said composition when applied to surfaces of hazardous waste material, and applying said composition containing said thixotropic agent over said surfaces of hazardous waste material in situ in an amount sufficient to form a flexible impermeable coating or foam, without prior treatment of said surface of said hazardous waste material.

2. The method of claim 1, wherein said composition containing said thixotropic agent is applied by spraying.

3. The method of claim 1, wherein said composition containing said thixotropic agent is applied by spraying to form a first coating, said first coati is permitted to set, and a second coating is applied by spraying.

4. The method claimed in claim 1, wherein said composition contains about 55% to about 65% by weight of an acrylic polymer, and wherein said thixotropic agent is a polyacrylic acid having a molecular weight of about 150,000 to about 275,000.

5. The method of claim 1, wherein said composition contains about 40% to about 60% by weight of a vinyl acetate-ethylene copolymer, and wherein said thixotropic agent is an alkoxypolyethylene glycol or an alkoxypolypropylene glycol having a molecular weight of at least about 1500.

6. The method of claim 5, wherein said hazardous waste materials contain toxic chemical compounds.

7. The method of claim 1, wherein said composition contains about 40% to about 60% by weight of a vinyl chloride copolymer latex, and wherein said thixotropic agent is sodium or ammonium polyacrylate.

8. A method for stabilizing and isolating hazardous waste materials of particulate and solid types, which comprises providing a non-toxic aqueous emulsion containing an acrylic polymer, adding a thixotropic agent to said emulsion in an amount sufficient to obtain a viscosity which will minimize run-off of said emulsion when applied to surfaces of hazardous waste material, said thixotropic agent comprising a polyacrylic acid having a molecular weight of about 150,000 to about 275,000, and applying said emulsion containing said thixotropic agent over said surfaces of hazardous waste material in situ in an amount sufficient to form a flexible impermeable coating or foam, without prior treatment of said surfaces of said waste materials.

9. The method of claim 8, wherein said emulsion containing thixotropic agent is applied by spraying.

10. The method of claim 8, wherein said emulsion containing said thixotropic agent is applied by spraying to form a first coating, said first coating is permitted to set and a second coating is applied by spraying.

11. The method claimed in claim 8, wherein said emulsion contains about 55% to about 65% by weight of said acrylic polymer.

12. A method for stabilizing and isolating hazardous waste materials of particulate and solid types, which comprises providing a non-toxic aqueous emulsion comprising an acrylic polymer containing a thixotropic agent, said thixotropic agent comprising a polyacrylic acid having a molecular weight of about 150,000 to about 275,000, and applying said emulsion over surfaces of said hazardous waste materials in situ in an amount sufficient to form a flexible impermeable coating or foam having a thickness ranging from about 0.5 to about 5.0 centimeters when dry, without prior treatment of said surfaces of said waste materials.

13. The method of claim 12, wherein said emulsion is applied by spraying.

14. The method of claim 12, wherein said emulsion is applied by spraying to form a first coating, said first coating is permitted to set, and a second coating is applied by spraying.

15. The method of claim 12, wherein said emulsion contains about 55% to about 65% by weight of said acrylic polymer, and wherein said thixotropic agent is present in an amount up to about 2% by weight.

16. The method of claim 12, wherein said hazardous waste materials contain radioactivity.

17. The method of claim 12, wherein said hazardous waste materials contain toxic chemical compounds.

18. A composition for the treatment and containment of hazardous waste materials, comprising an aqueous mixture containing an acrylic polymer, and a thixotropic agent comprising a polyacrylic acid having a molecular weight ranging from about 150,000 to about 275,000.

19. The composition of claim 18, wherein said mixture is an emulsion.

20. The composition of claim 19, wherein said acrylic polymer emulsion contains from about 55% to about 65% solids by weight.

21. The composition of claim 19, including up to about 1.5% of a surfactant.

* * * * *

UNITED STATES PATENT AND TRADEMARK OFFICE

CERTIFICATE OF CORRECTION

PATENT NO. : 5,318,730
DATED : June 7, 1994
INVENTOR(S) : Linda A. Rieser & John M. Christenson It is certified that error appears in the above-indentified patent and that said Letters Patent is hereby corrected as shown below:

Column 5, line 42, (claim 1), "surface" should read --surfaces--.

Column 5, line 48, (claim 3), "coati" should read -- coating--.

Signed and Sealed this

Thirtieth Day of August, 1994

*Attest:*

*Attesting Officer*

Bruce Lehman

BRUCE LEHMAN

*Commissioner of Patents and Trademarks*